US011737502B2

(12) United States Patent
Storey et al.

(10) Patent No.: US 11,737,502 B2
(45) Date of Patent: Aug. 29, 2023

(54) BODY-PROTECTOR

(71) Applicant: GEORGE TFE SCP, Monaco (MC)

(72) Inventors: Piers Christian Storey, Nice (FR); John George Lloyd, Monaco (MC); Felicity Boyce, Haywards (GB)

(73) Assignee: GEORGE TFE SCP, Monaco (MC)

( * ) Notice: Subject to any disclaimer, the term of this patent is extended or adjusted under 35 U.S.C. 154(b) by 0 days.

(21) Appl. No.: 17/910,828

(22) PCT Filed: Apr. 23, 2021

(86) PCT No.: PCT/IB2021/053360

§ 371 (c)(1),
(2) Date: Sep. 11, 2022

(87) PCT Pub. No.: WO2021/214722

PCT Pub. Date: Oct. 28, 2021

(65) Prior Publication Data

US 2023/0097084 A1 Mar. 30, 2023

(30) Foreign Application Priority Data

Apr. 24, 2020 (EP) ..... 20020197

(51) Int. Cl.
*A41D 19/015* (2006.01)
*A41D 31/28* (2019.01)
*A41D 13/015* (2006.01)

(52) U.S. Cl.
CPC ... *A41D 19/01523* (2013.01); *A41D 13/0156* (2013.01); *A41D 31/285* (2019.02)

(58) Field of Classification Search
CPC ..... A41D 19/015; A41D 19/01505; A41D 19/01523; A41D 13/0156; A41D 31/285; A63B 71/14; A63B 71/141
See application file for complete search history.

(56) References Cited

U.S. PATENT DOCUMENTS 4,570,269 A * 2/1986 Berlese ..... A41D 19/01523 D29/117.1
6,336,220 B1 * 1/2002 Sacks ..... A43B 1/0009 428/116

(Continued)

FOREIGN PATENT DOCUMENTS

EP 0836811 A2 2/1999
EP 2893824 A1 7/2015

(Continued)

*Primary Examiner* — Katherine M Moran
(74) *Attorney, Agent, or Firm* — Jason L DeFrancesco

(57) ABSTRACT

Body-protector (1,1') comprising: a wearable article (2,2'); a shock-absorbing pad (3) anchored to the wearable article (2,2'); wherein the shock-absorbing pad (3) comprises a first member (4) configured to absorb shock energy by an irreversible plastic deformation and a second member (5) configured to absorb shock energy by a reversible elastic deformation and wherein the first member (4) is embedded in the second member (5); wherein the first member (4) comprises a plurality of cells (6) interconnected each other via their sidewalls (7) to form a pliable sheet (8) configured to absorb energy through irreversible deformation of said sidewalls (7) or said interconnections in response to a compressive load applied to said sheet (8). Said wearable article (2) being a glove (2') wherein said shock-absorbing pad (3) is anchored to a back of the glove (2').

20 Claims, 9 Drawing Sheets

(56) References Cited

U.S. PATENT DOCUMENTS

| | | | | |
|---|---|---|---|---|
| 6,969,548 | B1 | 11/2005 | Goldfine | |
| 8,256,028 | B1 | 9/2012 | Ibon et al. | |
| 9,241,519 | B2 * | 1/2016 | Jaeger | A41D 19/01523 |
| 2008/0052799 | A1 * | 3/2008 | Yoo | A41D 19/01505 2/2.5 |
| 2009/0276933 | A1 * | 11/2009 | Dodd | A43B 17/00 2/22 |
| 2014/0223629 | A1 | 8/2014 | Choi et al. | |
| 2017/0087786 | A1 | 3/2017 | Wu et al. | |
| 2021/0235795 | A1 * | 8/2021 | Brierley | A41D 19/01523 |

FOREIGN PATENT DOCUMENTS

| | | | |
|---|---|---|---|
| JP | 2000045112 | A | 2/2000 |
| WO | 2019037068 | A1 | 2/2019 |

* cited by examiner

Fig.12
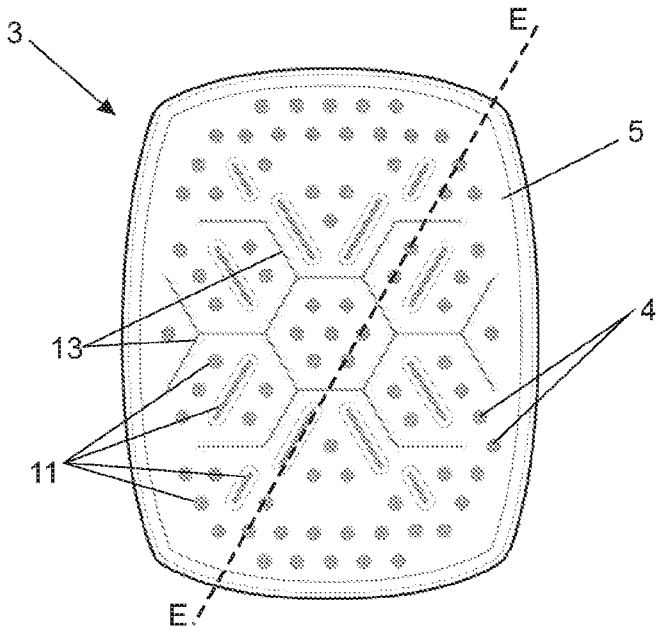
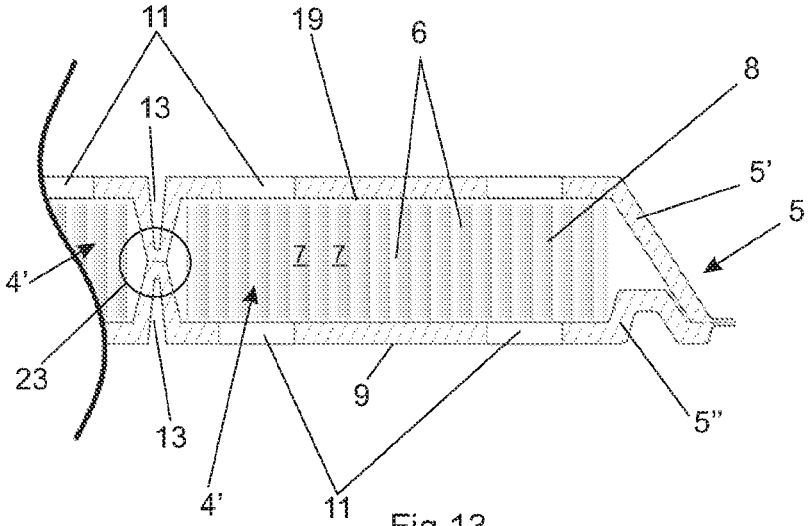
Fig.13
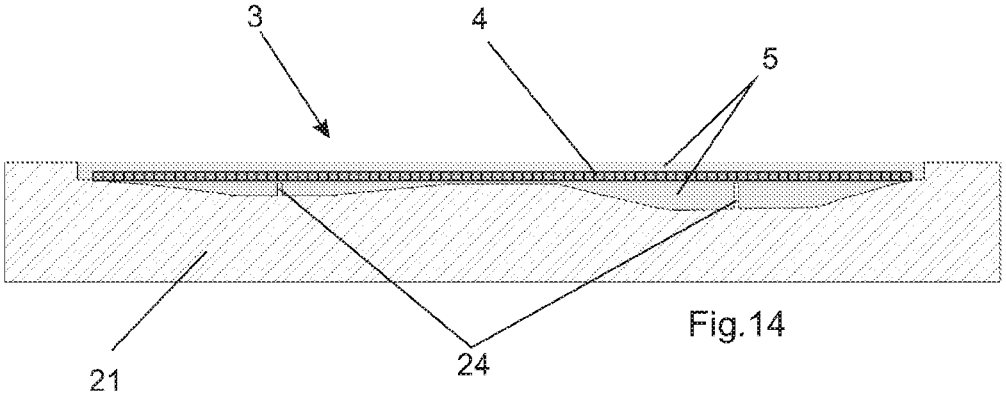
Fig.14

BODY-PROTECTOR

TECHNICAL FIELD

The present invention relates to the field of body-protectors for players or sportsmen. Preferably, it relates to protective gloves for sport activities like bike, ski, hockey, cricket.

BACKGROUND ART

In the state of the art several solutions for protecting the body from injuries are known.

In particular, some solutions are known in the field of gloves. Certain sports require gloves that must be highly flexible without detriment to hand protection. Examples in this sense are known for hockey and baseball gloves.

For example, document U.S. Pat. No. 8,256,028B1 provides a glove for baseball having a reticular structure containing and delimiting a plurality of impact absorbing pads filled with foam or rubber. In this solution, these cushions are arranged on the outer side of the glove and cover the bone of the hand aligned with the pinkie finger. In this body protector, the impacts are absorbed by elastic deformation and not by plastic deformation.

These elastic pads soften impacts by absorbing energy elastically, but elastic materials generate a rebound force during the impact that is transmitted to the underlying human body. This kind of elastic article can thus reduce impact force but not injuries determined by this kind of rebounding force. This kind of rebounding force is able to brake a bone or to damage hand ligaments.

Another solution similarly dealing the shock-absorption is disclosed in the document US20140223629A1. In this patent application, a shock absorbing member having a honeycomb structure made of rubber or silicone is covered by a separated outer layer and absorbs the energy elastically. Furthermore, in this solution, the shock absorbing member is not embedded with the outer layer, but simply covered it, consequently the honeycomb cells can easily buckle laterally absorbing very little impact energy.

A third solution is provided in the document WO2019037068A1. This solution describes a work glove that is not indicated for sport activities, because it is not sufficiently flexible for being used in a sport. This solution comprises pouch sections, fixed to the back of a glove, which contains an enhanced auxetic composite material. This enhanced auxetic composite material is made of a thermoplastic elastomer enveloping and permeating an auxetic sheet material. When the pouch section receives an impact, the auxetic material naturally disperses the energy from the impact over a wider surface and reduces the impact concentration, while the thermoplastic elastomer absorbs elastically the impact energy. The auxetic sheet material does not absorb energy, but simply spreads it on the elastomer material. In particular, it does not absorb energy through a plastic deformation. Consequently, this solution has the advantage of spreading the impact energy on a wider portion of the elastomeric material, but the impact energy is absorbed, here too, elastically and not plastically, with the drawback of generating said rebounding forces.

A further solution is provide by the document EP2893824, wherein is described a structure having a planar structure able to absorb the energy of an impact plastically, that is overlaid, above and below, by two plastic sheets which don't absorb energy but simply increases the area of the planar structure involved in the impact. Substantially, the plastic sheets, like in the previous solution, spreads the energy of impact instead of absorbing it. Furthermore, the planar structure is not embedded in the outer layers, because these layers cannot be considered a surrounding mass firmly and deeply fixing and supporting the planar structure. For this reason, the cells of planar structure collapse laterally in case on oblique impact and the energy absorbed is very little.

Another solution is disclosed in the document U.S. Pat. No. 6,969,548, wherein is described an impact absorbing composite that is formed of separate, discrete, and independent impact absorbing members.

An additional solution is disclosed in the document EP0836811, wherein is described a body-protector comprising one or more vessels wherein small bodies absorb the energy of an impact through their relative movements.

In view of the above-mentioned solutions, the state of the art does not provide a solution able to absorb the energy of an impact elastically and plastically at the same time, minimizing or eliminating the risk of injuries caused by rebounding forces typical of elastic shock-absorbers. Furthermore, a body-protector for hands that is flexible enough for performing sport or work activities without hindrance is absent. Furthermore, a body-protector is not known that can be easily inspected to check if it has been compromised by an impact or if it is still usable. Finally, a solution is not known that can be easily manufactured and have a great appearance.

SUMMARY

Said and other inconvenients of the state of the art are now solved by a body-protector comprising a wearable article and a shock-absorbing pad anchored to the wearable article. The shock-absorbing pad comprises a first member configured to absorb shock energy by an irreversible plastic deformation and a second member configured to absorb shock energy by a reversible elastic deformation. The first member is embedded in the second member. The first member comprises a plurality of cells interconnected each other via their sidewalls to form a pliable sheet configured to absorb energy through irreversible deformation of said sidewalls or said interconnections in response to a compressive load applied to said sheet. This kind of internal arrangement of the shock-absorbing pad allows to absorb a part of the energy of an impact through an elastic deformation of the second member and to absorb any surplus of energy or any rebounding force through a plastic deformation of the first member. Being the first member embedded in the second member, the energy of any impact is always firstly absorbed by the second member and secondly by the first member. This fact prevents sacrificial damage at every impact, even for small impacts, the first member, which is more technically sophisticated and expensive. Furthermore, as the first member is embedded in the second member, the first member is laterally supported by the second member and in case of oblique impacts, the first member does not crumple laterally. In this way, more energy is absorbed even in case of oblique impacts. Moreover, the pliable sheet is flexible according to its thickness direction allowing twisting movement of the body-protector with a simultaneous capacity of absorbing the energy of an impact through the collapsing of cells. This kind of deformation is irreversible and involves the sidewalls of cells and/or the interconnection between cells, allowing to absorb a lot of energy without rebound.

The term "irreversible plastic deformation" means any deformation that is permanent and consequently irreversible. In particular, this term means any kind of permanent buckling of the sidewalls of cells and/or any rupture of the interconnections between adjacent cells. This kind of deformation, implying a permanent deformation of materials, absorbs much more energy than an elastic reversible deformation. In the following, the terms "plastic", "plastically", "irreversible", "irreversibly" refer to the same concept, thus an "irreversible plastic deformation".

The term "reversible elastic deformation" means any deformation that does not imply a permanent deformation of materials and allows to the deformed element to return to its original shape. This behaviour is typical of elastic material like rubbers or silicones. In the following, the terms "elastic", "elastically", "reversible", "reversibly" refer to the same concept, thus an "reversible elastic deformation".

Preferably said second member can be a single-piece made of an elastic material. Being an elastic single-piece the second member is more durable, more resistant to impact and is less prone to fractures. Furthermore it supports laterally the first member avoiding lateral crumpling of it.

More preferably, the elastic material of the second member can be of the transparent type. In this way, any irreversible plastic deformation of the first member is perceivable without cutting or dismounting the shock-absorbing pad. If the first member undergoes an irreversible plastic deformation, the shock-absorbing pad is no longer safe and needs to be substituted. Additionally, or alternatively, the second member can comprise windows or passing-through holes configured to render the first member visible from outside.

Preferably, said sidewalls of the open cells can be at least in part normal to an inner face of the shock-absorbing pad. In this sentence, the term "at least in part" means that sidewalls are not entirely normal to the inner face. For example, a portion of the sidewall can comprise a geometric perturbation for reducing the initial peak of stress caused by the compression of sheet. The term "open", referred to these cells, means that each cell is a tube, thus is opened on the upper and lower faces.

More preferably, said sheet can have a thickness comprised between 0,5 and 30 mm or comprised between 1 and 5 mm depending on the application. If the thickness is small, the flexibility of the sheet according to its thickness direction is improved without detriment of irreversible plastic energy absorption. Eventually, the cross-sectional area of said cells can be comprised between 1.5 $mm^2$ and 30 $mm^2$. A small footprint allows to have more cells involved in the impact absorption.

In particular, the second member can comprise a recess wherein the first member is enclosed. In this manner, the first member can be substituted in case of damage.

Alternatively, the first member can be fully encapsulated in the second member. Preferably the second member can even permeate the first member. Being the first member encapsulated in the second member, the contact surface between these two elements is enlarged and the relative movements are limited. When an impact occurs, these points of contacts between the first and second members deteriorate, creating small disconnections. This irreversible plastic deformation absorbs a lot of energy because the contact surfaces between first and second members are many. Moreover when the second member permeates the first one, the crumpling of cells is supported and a more regular collapsing of cells during compression is obtained, even when the impact is not perpendicular to the shock-absorbing pad.

Advantageously, the first member can be sandwiched between a part of the second member and the wearable article. In this manner, the first member is not the first part of the shock-absorbing pad to receive and absorb the impact energy, but the second one. In this way, in case of small impacts, the first member is only minimally involved and does not deform plastically, because the impact is absorbed entirely by the second member and consequently the body-protector can be used again. Indeed, the elasticity of the second member renders this element reversible in case of impact.

In particular, the shock-absorbing pad can be anchored to the outer side of the wearable article so to remain exposed during normal use. In this way, the shock-absorbing pad faces outwardly and receives directly the collision. Furthermore, if the second member is transparent, the shock-absorbing pad is immediately inspectable.

Advantageously, the second member can comprise one or more outward directed thickenings and/or one or more cuts arranged on its outer face. Preferably, when the second member comprises both thickenings and cuts, said one or more cuts are arranged in correspondence of said one or more thickenings. These thickenings permit to improve the elastic absorption of impacts because of the greater thickness of the second member in these points. The cuts allow to improve the flexibility of the second member. If the cuts are arranged in correspondence of said thickenings, the minor flexibility determined by the thickenings is compensated by the cuts.

In particular, said second member can also comprise thinnings in-between said thickenings. These thinnings permit a greater flexibility of the second member in these portions. Preferably said first member can narrow or be absent in correspondence of said thinnings. Being the first member narrower in these zones or even absent, the transversal and torsional flexibility of the first member is improved.

The terms "thickening" and "thinning" means that local thickness of the second member is respectively higher or lower than average thickness of the second member.

In particular, said wearable article can be a glove and said shock-absorbing pad is anchored to a back of the glove. The main scope of present invention is that of providing a protective glove for sport or even work activities. When the glove has a shock-absorbing pad according to the present invention arranged on its backside, the impacts are absorbed more efficiently, because the shock-absorbing pad plays like an armour with respect to the underlying glove. Furthermore, no rebounding forces are transmitted to the hand, safeguarding its ligaments that are in fact on the back of hand.

When the wearable article is a glove, said cuts can be arranged so to extend in a width direction of the glove and said thickenings can be arranged in correspondence of metacarpophalangeal joints and/or knuckle joints of the glove. When the cuts are arranged transversally and in correspondence of the glove joints, the comfort for the wearer is improved and the glove can be employed even in sport activities, wherein a great freedom of movement is mandatory.

Preferably, said cuts can be normal or inclined with respect to the outer surface of the shock-absorbing pad anchored to the back of the glove. If the cuts are normal to the outer surface, the flexibility of the shock-absorbing pad is improved. If the cuts are inclined, the glove remains more protected from vertically oriented collisions.

Advantageously, a single piece of the first member can cover the back and some finger portions of the glove. If the first member is provided in a single piece, the coverture against impacts is uniform and less portions of the glove are vulnerable.

Preferably, the second member can comprise lateral extensions wrapping at least in part finger portions of the glove. These wrappings extend the protection against impacts even laterally, in the zone arranged between fingers.

These and other advantages will be better understood thanks to the following description of different embodiments of said invention given as non-limitative examples thereof, making reference to the annexed drawings.

DRAWINGS DESCRIPTION

In the drawings:

FIG. 12 shows an upper view of a shock-absorbing pad according to a sixth embodiment of the present invention;

FIG. 13 shows a cross-sectional view of the shock-absorbing pad of FIG. 12 according to a sectional plan E-E;

FIG. 14 shows a cross-sectional view of a mould used for realizing a shock-absorbing pad 3 according to the present invention;

DETAILED DESCRIPTION

The following description of one or more embodiments of the invention is referred to the annexed drawings. The same reference numbers indicate equal or similar parts. The object of the protection is defined by the annexed claims. Technical details, structures or characteristics of the solutions herebelow described can be combined with each other in any suitable way.

Figure 1:
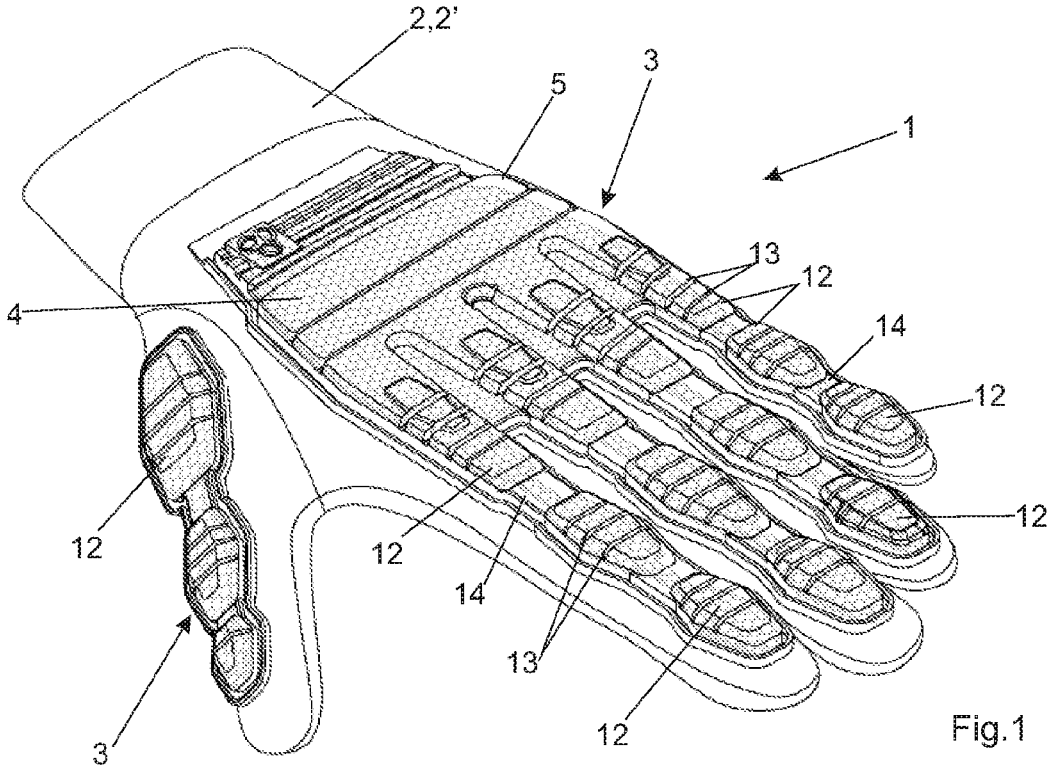
FIG. 1 shows a perspective view of a body-protector according to a first embodiment of the present invention.
Figure 2:
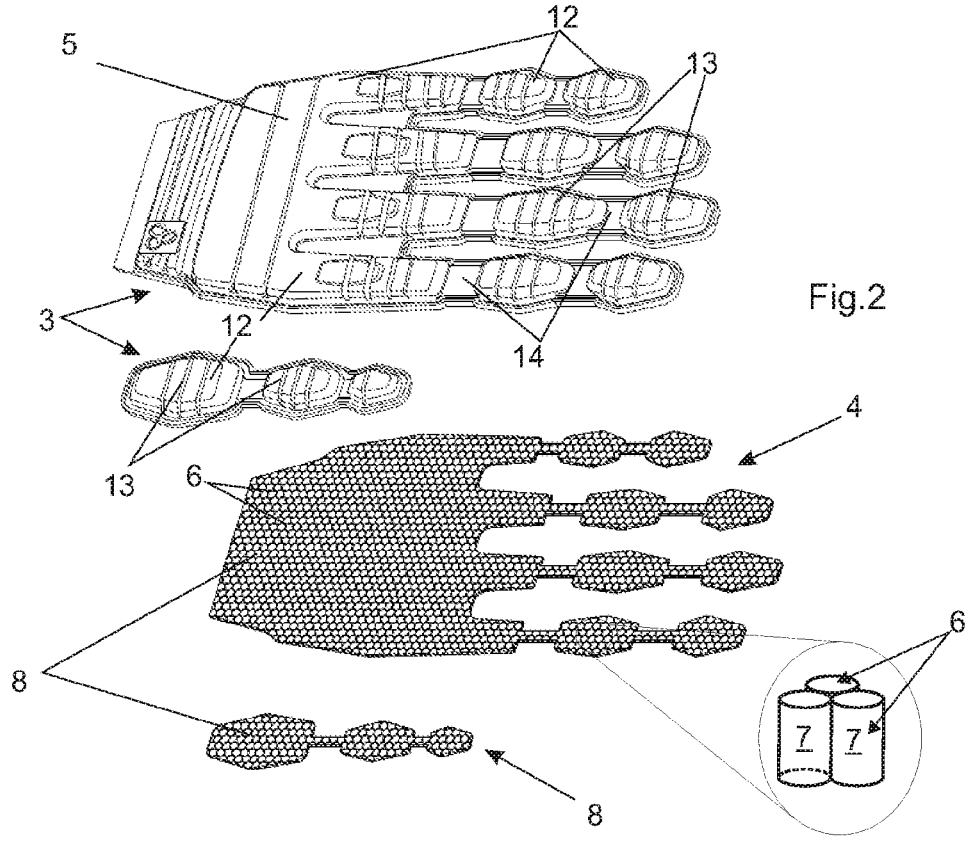
FIG. 2 shows an exploded view of the shock-absorbing pads of the body-protector of FIG. 2.

In FIGS. 1-3 is represented a first embodiment of the body-protector according to the present invention. While in FIGS. 4-7 is represented a second embodiment of said body-protector. These embodiments differentiate only by a few technical features that are highlighted in the following. A part from these differences, the other technical characteristics are equal or substantially equal, consequently they are described only once.

The body-protector 1 of both embodiments comprises a wearable article 2, in these cases a glove 2', to which is attached a shock-absorbing pad 3. In turn, the shock-absorbing pad 3 comprises a first member 4 and a second member 5.

The first member 4 is configured to absorb the energy of an impact through an irreversible deformation of the first member 4, while the second member 5 is configured to absorb elastically the energy of the impact. The first member 4 is arranged into the second member 5 as better clarified in the following.

The second member 5 is a body of an elastic material wherein the first member 4 is arranged. The elastic material is preferably an elastomer, a polyurethane or a silicone.

In the first embodiment of FIGS. 1-3, the first member 4 is fully encapsulated in the second member 5, as represented in FIG. 3, while in the second embodiment of FIGS. 4-7, the first member 4 is inserted in a recess 10 of the second member 5. This is the main difference between said first and second embodiments.

Figure 4:
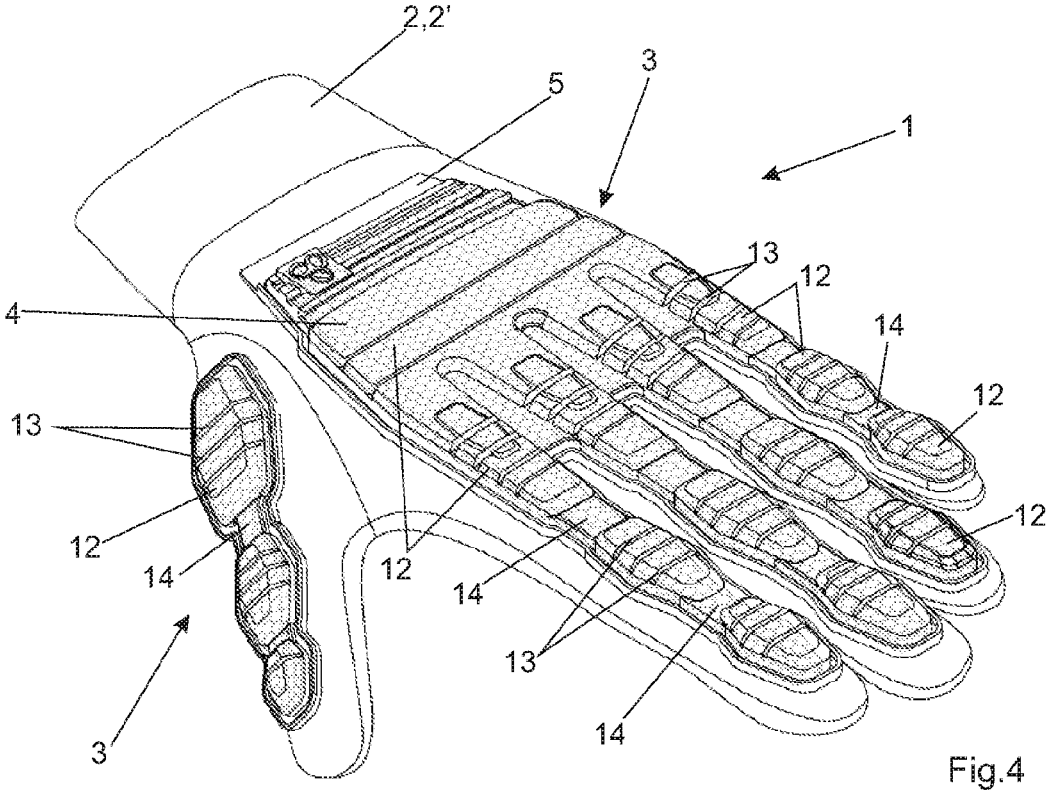
FIG. 4 shows a perspective view of a body-protector according to a second embodiment of the present invention.

As represented in FIGS. 1 and 4, the elastic material of the second member 5 is of a transparent type so to render visible from outside the first member 4.

In particular, the transparent elastic material can be a transparent silicon, a transparent thermoplastic elastomer like that known under the commercial name Phonix™, or a clear urethane rubber like that known under the commercial name ClearFlex™.

The fact of being transparent or clear facilitates seeing the first member 4 without dismounting the shock-absorbing pad 3. This advantageously enables checking to see if the first member 4 has irreversibly plastically collapsed after an impact. If the first member 4 irreversibly deforms after a shock, it remains deformed and its deformation can be seen through the transparent second member 5. In this way, a glove 2' having a deformed first member 4 can be substituted with a new one having a still intact first member 4. Alternatively to the substitution of the entire glove 2', the glove 2' can be repaired with a new shock-absorbing pad 3.

The first member 4 of said first and second embodiments comprises a plurality of open cells 6 which are interconnected to each other via their sidewalls 7 to form a sheet 8. In particular, the cells 6 are organized and oriented so to absorb the energy of an impact through compression of the sheet 8. This sheet 8 thus comprises an array of interconnected open cells 6.

When an impact on the body-protector 1 occurs, the first member 4 absorbs a part of the impact energy through an elastic deformation of the first member 4. Simultaneously, the array of cells 6 of the second member 5 acts like a mesh that spreads the impact energy on a wider portion of the shock-absorbing pad 3, and deforms permanently. This permanent deformation, which can involve the sidewalls 7 of the cells 6 and/or their interconnections, absorbs a great quantity of impact energy, minimizing the risks for the wearer. Said interconnection consists of the portion of sidewalls 7 used to interconnect adjacent cells 6.

Figure 16A:
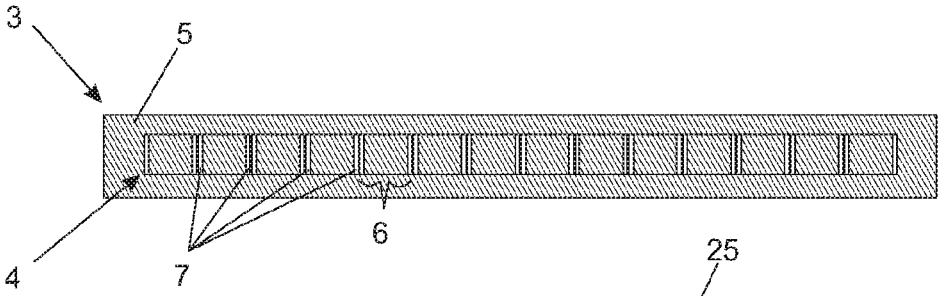
FIG. 16A shows a schematic side cross-section view of an example of a shock-absorbing pad before an impact occurs.
Figure 16B:
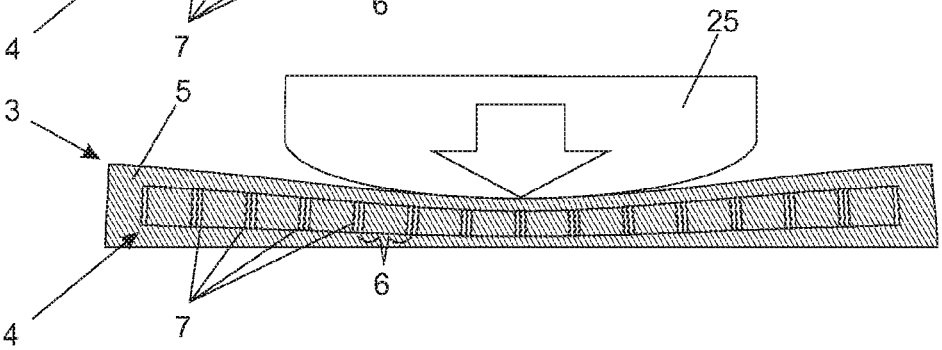
FIG. 16B shows a schematic side cross-section view of the shock-absorbing pad of FIG. 16A when a normal impact occurs.

In this case, the cells 6 involved in the impact axially collapse and their sidewalls 7 irreversibly crumple, absorbing the impact energy, as better shown in FIG. 16B.

Each open cell 6 is attached to the neighbouring cells 6 along their sidewalls 7. Another type of irreversible energy absorption can involve these interconnections between cells 6. Since the cells 6 are connected each other, when an impact occurs against the shock-absorbing pad 3, the sidewalls bent and irreversibly deform in correspondence of said interconnections, as shown in FIG. 15B.

The sidewalls 7 can thus be shared between near cells or not.

Figure 5:
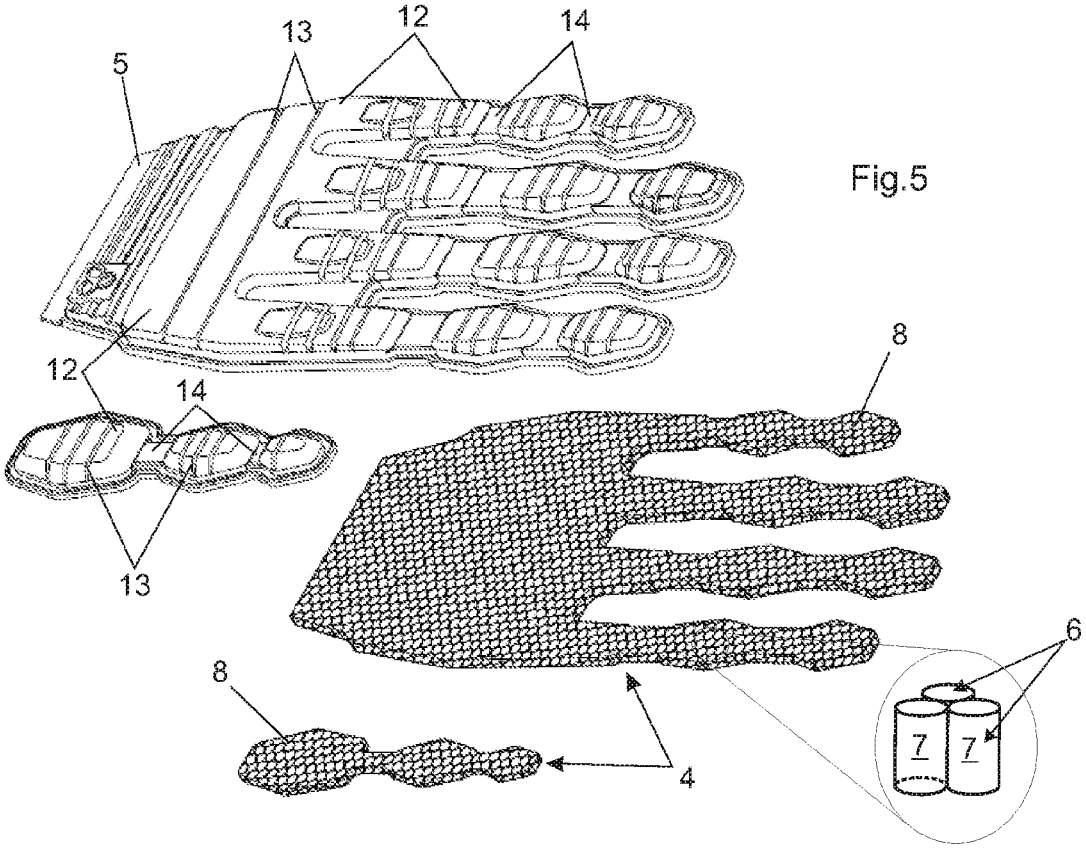
FIG. 5 shows an upper exploded view of the shock-absorbing pads of the body-protector of FIG. 4.

With reference to FIG. 2 or 5, this interconnection between open cells 6 is represented by the surface of contact between adjacent cells 6. This link between cells 6 can be just a line or a surface depending on the shape of the cell's cross-section and/or on the type of interconnections.

In the example represented in detail in FIG. 2 or 5, the cells 6 are short cylinders of polycarbonate interconnected each other. In the point of connection the sidewall 7 of a cell 6 is connected to the sidewall of another cell 6, for example with adhesive or other kind of bonding.

In a version of the sheet, not represented, the sidewalls of cells can be shared between neighbouring cells. The cells can be realized by means of two strips of plastic material undulated according to different substantially sinusoidal profiles and connected each other in correspondence of the minimums of said sinusoidal profiles, so to obtain a string of closed cells, each one shaped like the point of an arrow. Different strings of cells so realized are then connected each other bonding the maximum of the biggest sinusoidal profile of a string with the maximum of the smallest sinusoidal profile of another string. In this way, a sheet is created and the energy of an impact can be plastically absorbed by the collapsing of said cells.

Figure 3A:
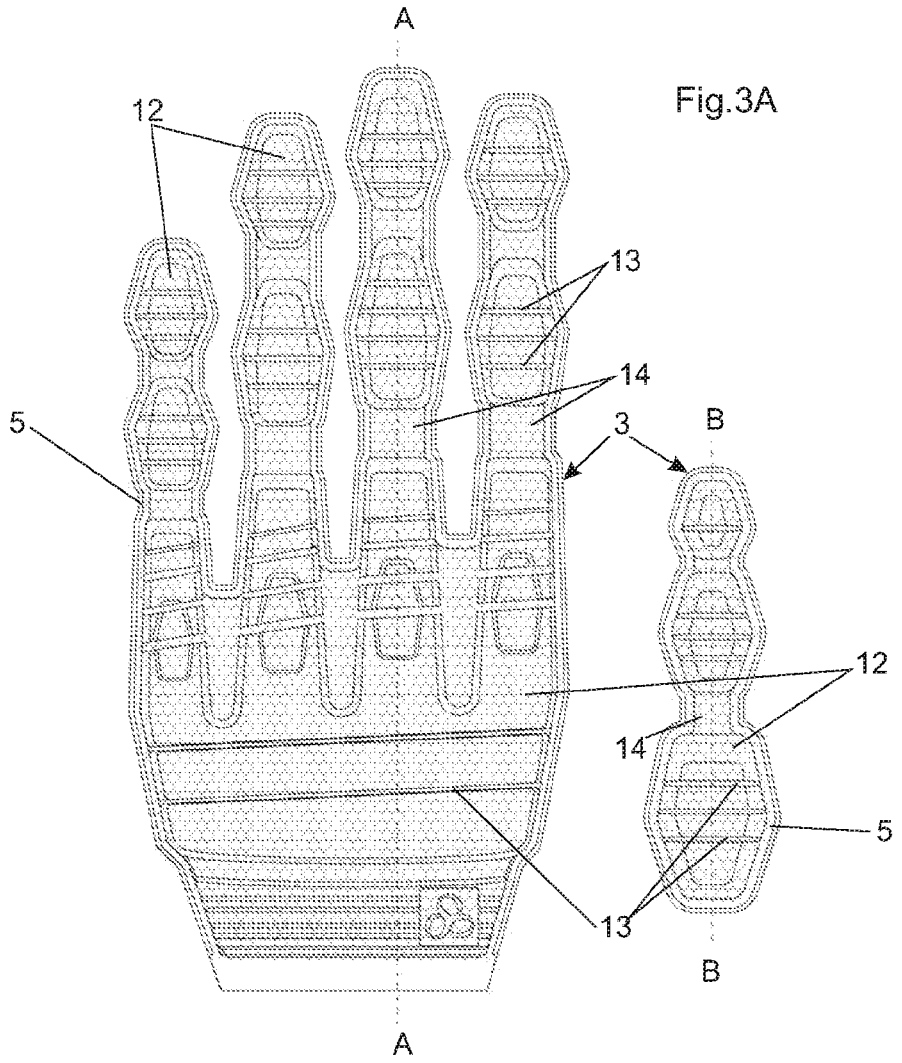
FIG. 3A shows an upper view of the shock-absorbing pads of FIG. 2.
Figure 3B:
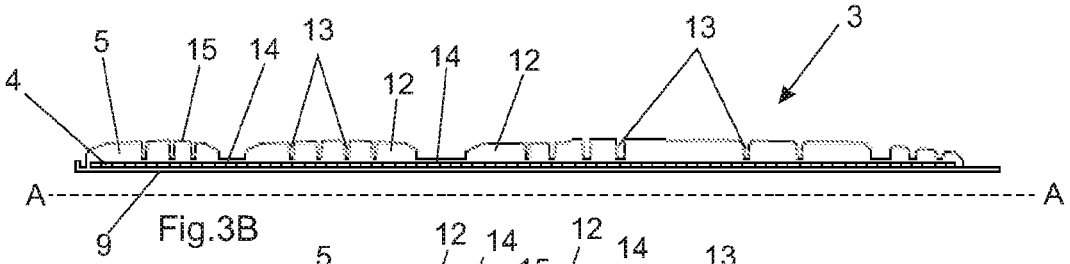
FIG. 3B shows cross-sectional view of the shock-absorbing pad of FIG. 3A according to a sectional plan A-A.
Figure 3C:
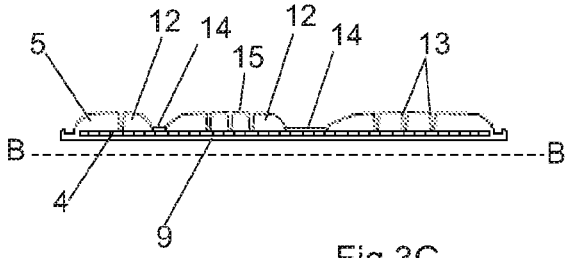
FIG. 3C shows a cross-sectional view of the shock-absorbing pad of FIG. 3A according to a sectional plan B-B.

In order to maximise the energy absorbed through the irreversible plastic deformation of said sidewalls 7 of the first member 4, the sidewalls 7 are normal to the inner face 9 of the shock-absorbing pad 3. This perpendicularity is clearly perceivable in FIGS. 3B and 3C for the first embodiment or in FIGS. 7B and 7C for the second embodiment. In the first embodiment, the inner face 9 of the shock-absorbing pad 3 corresponds to the inner face of the second member 5, as represented in FIGS. 3B and 3C. In the second embodiment, the inner face 9 of the shock-absorbing pad 3 corresponds to the perimeter edge of the second member 5 as represented in FIGS. 7B, 7C or even better in FIG. 6.

In FIGS. 1-7, the shock-absorbing pad 3 and its first and second members 4,5 are always represented flat for the sake of simplicity, but they can obviously flex. The second member 5 is made of an elastic material consequently is flexible in all directions, and the first member 4 is made of a thin sheet 8 consequently can flex along its thickness direction. In this way, the resulting glove 2' is flexible and the fingers of the wearer can move without any difficulty. For this reason, these gloves 2' are particularly suitable for sport activities like hockey, baseball, bike or the like.

In order to make the sheet 8 extremely pliable the first member thickness is comprised between 0,5 and 5 mm, preferably between 1 and 2 mm.

FIG. 2 represents two sheets 8 of first member 4. A bigger and indented sheet 8 is the sheet for the back of the hand and for the back of forefinger, middle finger, ring finger and pinkie finger, while the smaller sheet 8 is the sheet for the back of thumb. Both sheets 8 are independent and single. Each sheet 8 comprises wider portions arranged in correspondence of the metacarpophalangeal joints alternated by narrower portions which permit a great flexibility of the sheet 8 along its thickness direction.

Figure 6:
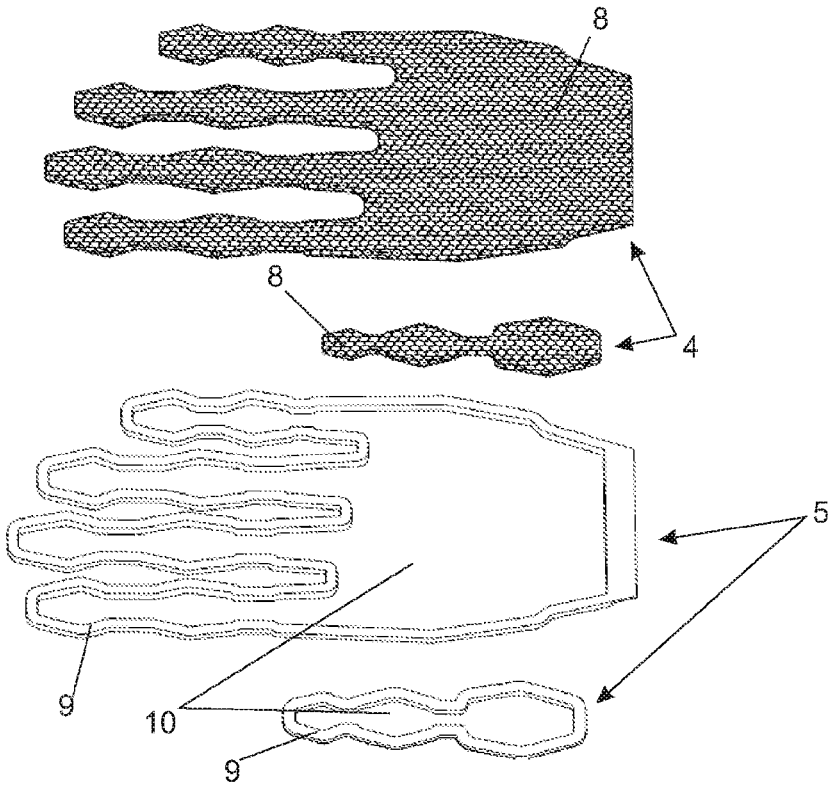
FIG. 6 shows a lower exploded view of the shock-absorbing pads of the body-protector of FIG. 4.

The sheets 8 of second embodiment of the body-protector 1, represented in FIGS. 5 and 6, are similar to those of first embodiment, with the difference that the narrower portions are less strict. In this way, the shock-absorbing resistance of the glove 2' is improved in these zones.

The sheets 8 of first and second embodiments are thin and their thickness is comprised between 1 and 5 mm. For gloves, the thickness of the sheet 8 can be smaller, up to 0.5 mm, while for back protectors, the thickness is bigger, up to 30 mm. As described in the following, when the body-protector 1 is not a glove, for example it is a back protector 1', the thickness of said sheet 8 is bigger than that employed for gloves 2'.

In particular, the open cells 6 are dimensioned so that more cells insist on the area of the glove 2' to protect. For example, in correspondence of the fingers, the first member 4 can't be particularly wide and consequently the cells 6 need to be smaller. In this way, several cells 6 can lie over the area covering glove's digits. For this reason, the cross-sectional area of the cells 6 is comprised between 1.5 $mm^2$ and 30 $mm^2$.

As already said, in the first embodiment, the first member 4 is completely wrapped by the second member 5. Preferably, as represented in FIGS. 3B and 3C, the second member 5 permeates the open cells 6 of the first member 4. In this way, the elastic material fills the cells 6 supporting the sidewalls during shocks. According to another embodiment, which looks similar to that of FIGS. 3B and 3C, the sheet 8 of the first member 4 is surrounded by the second member 5 but it's not permeated by the latter. In this case, the first member 4 is arranged in an inner bubble of the second member 5 that fits the first member 4.

This kind of shock-absorbing pad 3 can be obtained arranging a sheet 8 of first member 4 in a mould 21 as represented in FIG. 14. The mould 21 is shaped according to the outer surface 15 of the second member 5 and comprises ridges 22 that allow to realize the cuts 13 of the second member.

In the mould 21, the sheet 8 of the first member 4 is arranged and can lay on said ridges 22 or on specific points of the mould 21. Once the sheet 8 is positioned in the mould 21, the elastic resin, for example a polyurethane resin, is poured in the mould 21 so to cover and permeate the first member 4.

Once this resin solidifies, the shock-absorbing pad 3 is realized and the second member 5 fully encapsulates the first member 4.

In order to avoid the material of second member 5 permeates the open cells 6 of the first member 4, a film can be arranged over the sheet 8 on both sides, so to prevent the resin to enter in the cells 6 during the pouring. In this way, the first member 4 remains encapsulated in an inner cavity of the second member 5.

Alternatively, as represented in FIGS. 6 and 7, the glove 2' of the second embodiment comprises a second member 5 having a recess 10, like a pocket, having a shape complementary to that of the first member 4. In this way, when the first member 4 is accommodated in this recess 10, the inner surface of the sheet 8 is coplanar to the perimeter edge 9 of the second member 9, as represented in FIGS. 7B and 7C. This version allows an easy substitution of the first member 4 in case of an irreversible deformation.

Figure 7A:
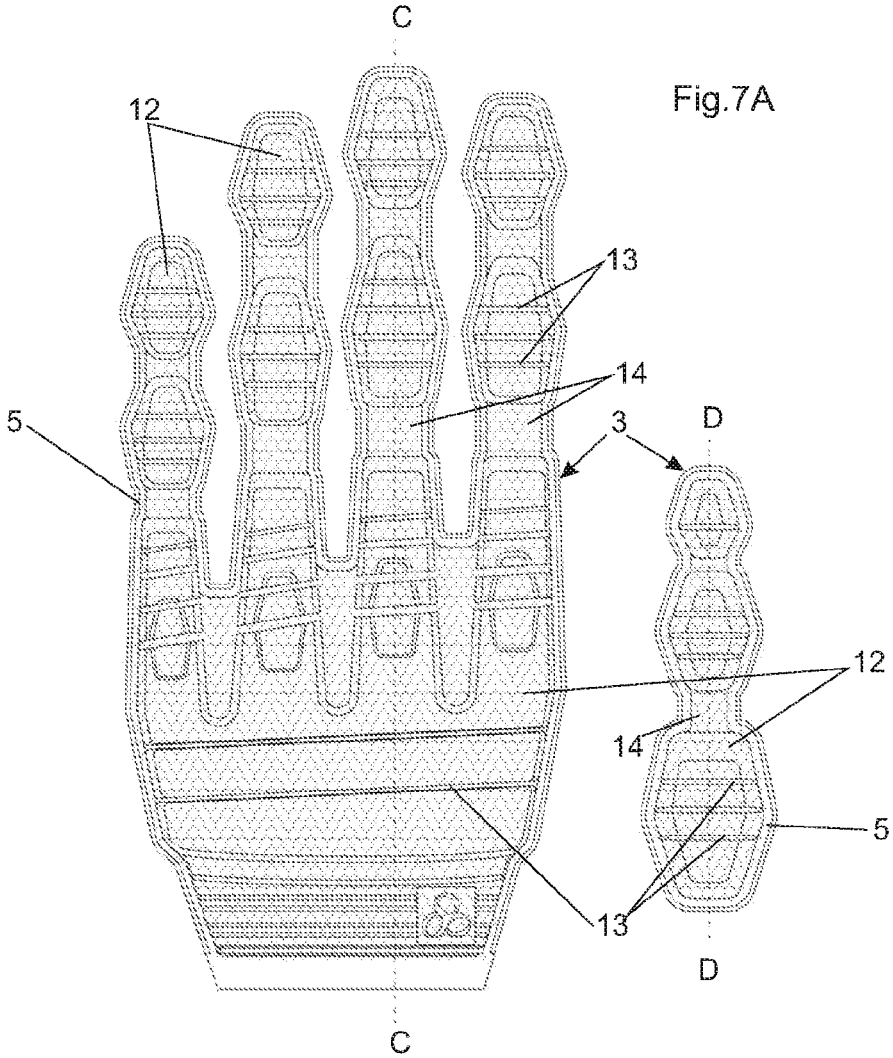
FIG. 7A shows an upper view of the shock-absorbing pads of FIGS. 5 and 6.
Figure 7B:
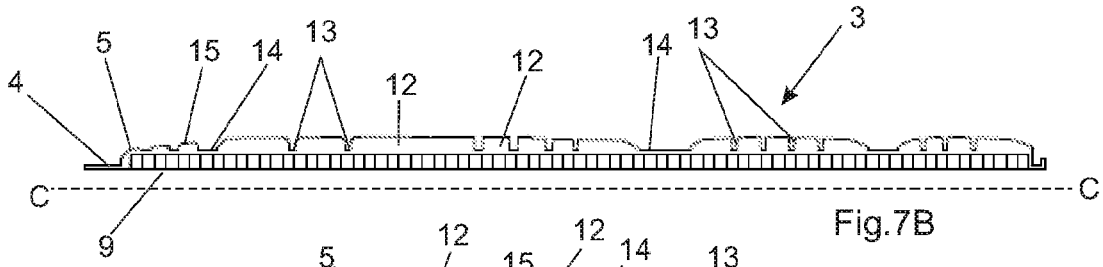
FIG. 7B shows a cross-sectional view of the shock-absorbing pad of FIG. 7A according to a sectional plan C-C.
Figure 7C:
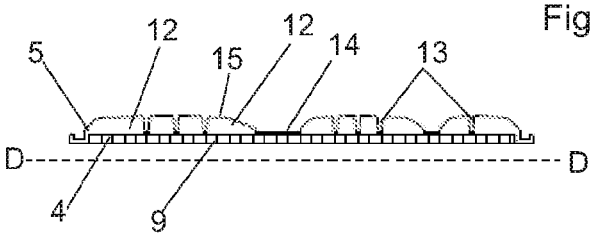
FIG. 7C shows a cross-sectional view of the shock-absorbing pad of FIG. 7A according to a sectional plan D-D.
Figure 8:
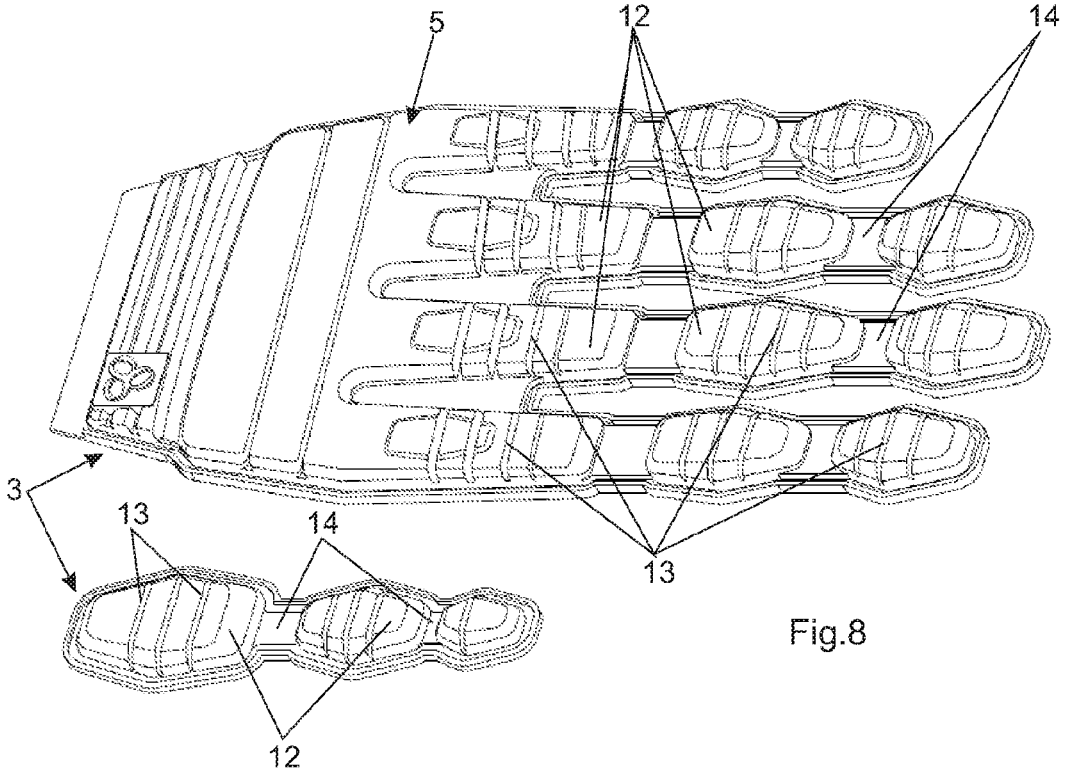
FIG. 8 shows a perspective view of a particular kind of shock-absorbing pad.

FIGS. 3B and 3C, as well as FIGS. 7B and 7C, represent longitudinal cross-sectional view of the shock-absorbing pads 3 of respective first and second embodiments. In FIGS. 3A and 7A are indicated the sectioning planes according to which these cross-sectional views are realized.

In the first and second embodiments, the shock-absorbing pad 3 is anchored to outer side of the glove 2', in particular to the back of the glove 2', as represented in FIGS. 1 and 4. In this way, the first member 4 is sandwiched between a part of the second member 5 and the glove 2'. Consequently, the first portion of the shock-absorbing pad 3 receiving the impact is the elastic second member 4 and residual energy of the impact or any rebounding force is transmitted to the first member 4 that deforms irreversibly. In this way, no rebounding forces are transmitted to the hand of the wearer.

According to one or more embodiments of the present invention, the irreversible plastic deformation can involve the sidewalls 7 of the cells 6 and/or the interconnections between adjacent cells 6.

In the FIGS. 15 and 16 is represented what happens when a shock-absorbing pad 3 of the present invention is impacted.

Figure 15A:
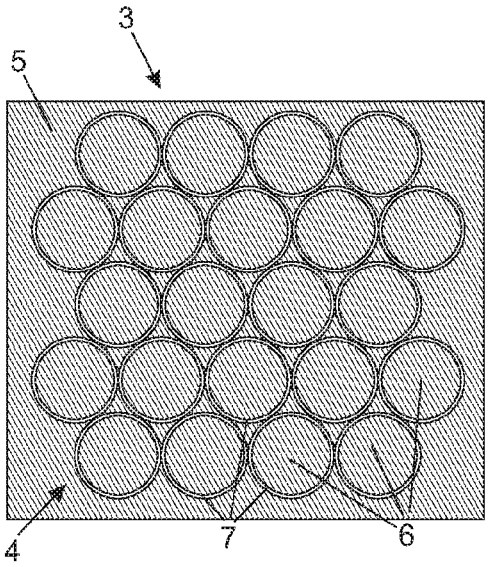
FIG. 15A shows a schematic top cross-section view of an example of a shock-absorbing pad before an impact occurs.
Figure 15B:
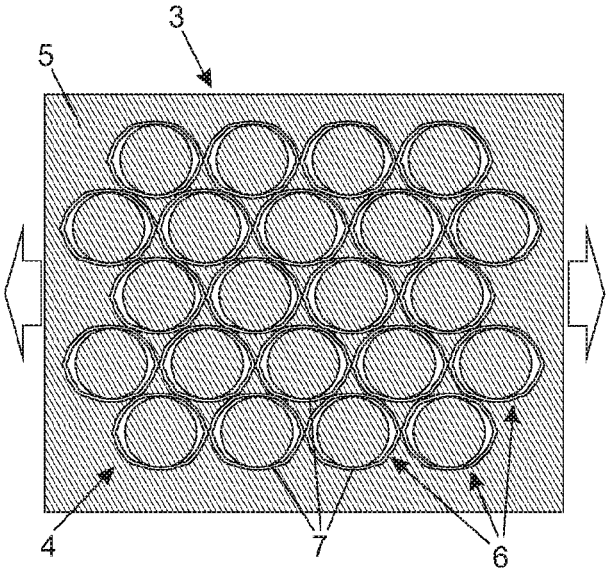
FIG. 15B shows a schematic top cross-section view of the shock-absorbing pad of FIG. 15A after an impact occurs.

In particular, FIGS. 15A and 16A represent the shock-absorbing pad 3 before an impact occurs. The cells 6 are intact. In the example, an array of interconnected cells 6 is represented.

Figure 16C:
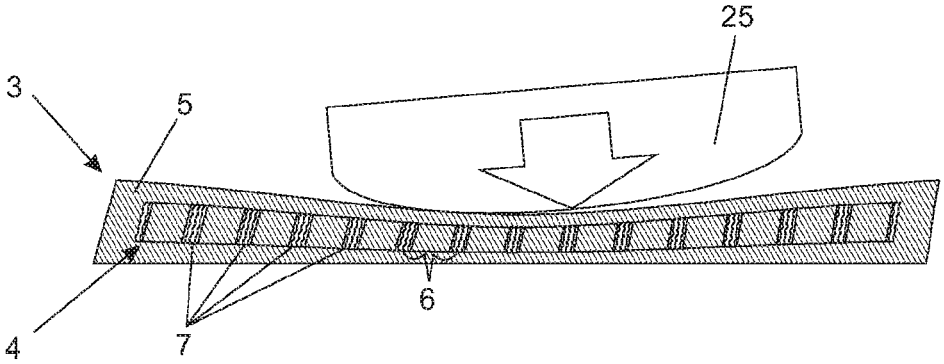
FIG. 16C shows a schematic side cross-section view of the shock-absorbing pad of FIG. 16A when an inclined impact occurs.

When an impact between an object 25 and the shock-absorbing pad 3 occurs, the top portion of the elastic material of the second member 5 deflects transmitting the impact strength to the first member 4, as shown in FIG. 15B,16B or 16C.

At this point, the sidewalls 7 of the cells 6 irreversibly crumple, absorbing a large amount of the energy impact, as FIGS. 16B and 16C show. This kind of deformation of the sidewalls 7 is an irreversible plastic deformation.

Simultaneously, the array of cells 6 acts as a mesh spreading the impact strength on the bottom portion of the second member 5. The interconnections between cells 6 allow to involve more cells 6 in the impact energy absorption.

In addition, the interconnections between sidewalls 7 of cells 6 imply a second type of irreversible deformation, thus the deformation of sidewalls 7, as the deformed cross-sections of cells 6 as FIG. 15B show. The cells 6 are stretched by the neighbour cells 6 involved in the impact and this type of deformation limits and absorbs the impact energy. The energy absorption thus takes place through the deformation or even the rupture of said interconnections between sidewalls 7. In this way, a second portion of the impact energy is absorbed, as shown in FIG. 15B or FIG. 16B. Even in this case, the sidewalls 7 deform permanently through an irreversible plastic deformation.

A further type of energy absorption can occur when the second member 5 permeates the open cells 6 of the first member 4. In this case, a disconnection between the first and second members 4,5 can take place. Substantially, when an impact on the shock-absorbing pad 3 happens, in particular when the impact is inclined with respect to the outer surface of the shock-absorbing pad 3, a disconnection between the material of the second member 5 and the material of the first member 4 can take place, as shown in FIGS. 15B and 16C. In these figures, it's clearly represented that the connection of the second member 5 breaks up from the material of the first member 4. This kind of breakage, that is irreversible, represents a third type of irreversible plastic deformation of the first member 4.

As represented in FIGS. 1-7, the second member 5 comprises a plurality of thickenings 12, thus portions which are particularly thicker with respect to the rest of the second member 5. These thickenings 12 are used for improving the bumping effect of the elastic second member 5. In said first and second embodiments, these thickenings 12 are arranged in correspondence of the metacarpophalangeal joints 17 and knuckle joints 17 of the glove 2'. These portions of the glove 2', and thus of the wearer's hand, are the more exposed to impacts. For this reason, the second member 5 is thicker in these portions, for absorbing more energy of the impact.

Furthermore, the embodiments of FIGS. 1-7 also comprise some cuts 13 arranged on the outer surface 15 of the second member 5. These cuts 13 are in particular arranged in correspondence of said thickenings 12.

These cuts 13, which are oriented according to the width direction of the glove, as FIGS. 3 and 7 clearly indicate, permit a better flexion in correspondence of the portions of the shock-absorbing pad 3 that are more exposed to elongation. Moreover, being the cuts 13 arranged in correspondence of the thickenings 12, these cuts 13 facilitate the flexion of these thicker portions. In particular, the cuts 13 are oriented according to the width direction of the glove 2' for permitting the flexion of wearer fingers.

In the portions of the shock-absorbing pad 3 which do not require said thickenings 12, in particular in those comprised between said metacarpophalangeal and knuckle joints 16,17, the second member 5 comprises thinnings 14, thus portions that are particularly thin. These thinnings 14 allow an improved flexibility in the second member 5 when the fingers flex.

The sheet 8 of the first member 1 has an almost uniform width, as FIGS. 3 and 7 show, but in correspondence of these thinnings 14 the sheet 8 can be particularly strict, as represented in FIGS. 1 and 2 of the first embodiment. This strict portions of the first member 4, together with the thinnings 14 of the second member 5, permit a great flexibility of the body-protector 1.

The FIG. 1, like the FIG. 4, represents the entire body-protector 1, with the glove 2', thus the wearable article 2, the shock-absorbing pad 3, and its first and second members 4,5. The FIGS. 2, 5 and 6 represent the first member 4 separated by the second member 5. While the FIGS. 4 and 7 represent the shock-absorbing pad 3 sectioned with specific details of the relationship between first and second members 4,5.

Figure 9:
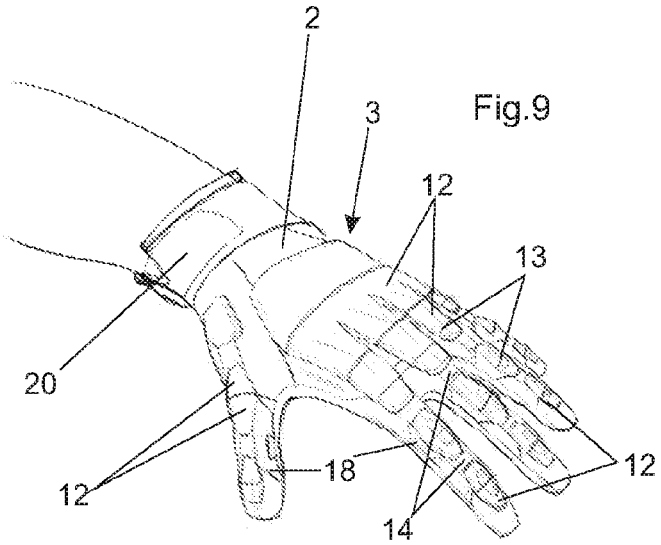
FIG. 9 shows a perspective view of a body-protector according to a third embodiment of the present invention.

FIG. 9 represents a particular embodiment of the shock-absorbing pad 3, wherein the second member 5 is made of an elastic material that is not transparent and consequently the embedded first member 4 is not visible.

With reference to FIG. 9, a third embodiment of the body-protector 1 is represented, wherein the thickenings 12 of the fingers are dome-shaped and comprise only one cut 13 per thickening 12. In this embodiment, the shock-absorbing pad 3 in correspondence of the back of the hand is substantially flat and has a substantially uniform thickness. The thickenings 12 are spaced out by thinnings portions 14 arranged in correspondence of the distal, middle and proximal phalanges. The cuts 13 are normal with respect to the outer face 15 of the shock-absorbing pad 3. The shock-absorbing pad 3 of this embodiment has a second member 3 comprising lateral extensions 18 that wrap in part the finger portions of the glove 2'.

Figure 10:
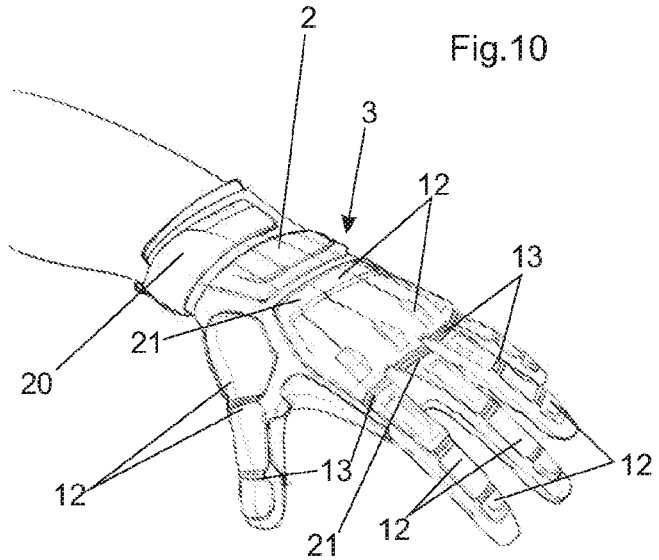
FIG. 10 shows a perspective view of a body-protector according to a fourth embodiment of the present invention.

With reference to FIG. 10, a fourth embodiment of the body-protector 1 is represented, wherein the second member 5 comprises some concave portions in correspondence of the back of hand and in correspondence of proximal phalanges. On the edge of these concave portions ridges are present which constitute the thickenings 12. Further thickenings 12 are also arranged in correspondence of the knuckle joints. Three cuts 13 for each flexural joint are also provided for improving the flexibility of digits. The cuts 13 are normal with respect to the outer face 15 of the shock-absorbing pad 3. The thumb also comprises a second member 5 having an almost constant thickness.

Figure 11:
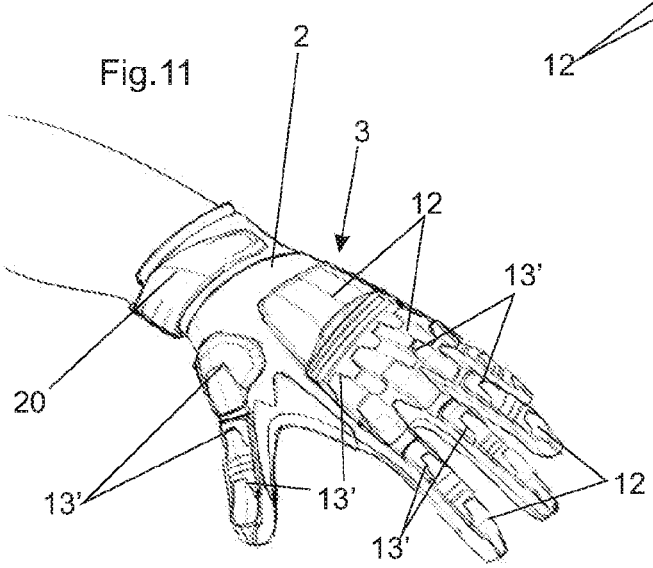
FIG. 11 shows a perspective view of a body-protector according to a fifth embodiment of the present invention.

With reference to FIG. 11, a fifth embodiment of the body-protector 1 is represented, wherein some thickenings 12 are arranged in correspondence of the knuckle and metacarpophalangeal joints. These thickenings 12 comprise oblique cuts 13', which are inclined with respect to the outer face 15 of the shock-absorbing pad 3. These inclined cuts 13' permit to the portion of the second member 5 above the inclined cut 13' to move and slide with respect to the portion of the second member 5 below the inclined cut 13', as happens in the armoured shell of armadillos. In this way, the flexibility is even more improved and the body-protector 1 is more comfortable.

With reference to FIGS. 12 and 13, it's represented another type of shock-absorbing pad 3, which can be adapted on the back of a glove 2' or in a different wearable article 2. In particular, a shock-absorbing pad having this or a similar shape, can be used in a back-protector. For example, one or more of the shock-absorbing pad of FIG. 12 can be anchored to the outer side of a back wearable article, like a backpack. In this way, the shock-absorbing pad 3 remains exposed during its normal use and can inspected.

In this embodiment, the second member 5 covers the first member 4 and the latter comprises a plurality of cells 6 interconnected each other along their sidewalls 7 so to realize a sheet 8. This sheet 8 is divided in a plurality of portions, constituting the first member portions 4'. These portions are independent and each one absorb the energy of an impact plastically by deformation of the cells sidewalls 7. These first member portions 4' are arranged in chambers 19 of the second member 5. An upper layer 5' of elastic material is bonded with a lower layer 5" of elastic material so to form a second member 5 comprising a plurality of chambers delimited by bonding zone 23. In this zones 23 the elastomeric layers 5', 5" are melted or glued so to be permanently connected. Substantially this type of second member 5 is monolithic.

Into each chamber 19 is arranged a first member portion 4'. Since the upper and lower layers 5',5" are recessed in correspondence of said bonding zone 23, the shock-absorbing pad 3 comprises cuts 13 that permit a flexion of the shock-absorbing pad 3 along these linear cuts 13. These bonding zones 23 identify thinnings of the second member 5 that act like hinges.

The sidewalls 7 of the cells 6 are normal to the upper and lower layers 5,5", consequently they are normal to the inner and outer faces of the shock-absorbing pad 3. In this sixth embodiment of the shock-absorbing pad 3, the sheet 8 of the first member 4 can be thicker with respect to previous embodiments and its thickness can be comprised between 6 and 20 mm, but can arrive to 30 mm.

In this embodiment, the second member 5 does not penetrates in the cells 6 of the first member 4. The first member 4 is fully encapsulated in the second member 5 and cannot come out.

The shock-absorbing pad 3 of this embodiment has a second member 5 that comprises a plurality of windows 11 which render visible the first member 4 from outside. These windows 11 are apertures of said upper and lower layer 5',5" as represented in FIG. 13. The size of these windows 11 is greater than the cross-sectional area of a plurality of the cells 6, so to enable the inspection of structural status of said cells 6. Alternatively, like in the first and second embodiments, the second member 5 can be made of a transparent material, with or without windows 11, for rendering visible the first member 4.

Preferably, in all the embodiments of the invention, if the elastic material of the second member 5 is soft, thus when the elastic material has a shore A degree comprised between 10 and 60, the first member 4 also provides a skeleton effect. If the elastic material is soft, the second member 5 is less durable and particularly subject to wear and over time can rupture or tear. On the contrary, when the first member 4 is arranged into this soft second member 5, the more rigid structure of the first member 4 acts as a skeleton, and consequently the durability of second member 5 is improved, in particular when the second member 5 permeates said skeleton. An elastomeric foam is considered too soft for being used as second member 5 in the present shock-absorbing pad 3.

Concluding, the invention so conceived is susceptible to many modifications and variations all of which fall within the scope of the inventive concept, furthermore all features can be substituted to technically equivalent alternatives. Practically, the quantities can be varied depending on the specific technical requirements. Finally, all features of previously described embodiments can be combined in any way, so to obtain other embodiments that are not herein described for reasons of conciseness and clarity.

The invention claimed is:

1. Body-protector comprising:

a wearable article;

a shock-absorbing pad anchored to the wearable article;

wherein the shock-absorbing pad comprises a first member configured to absorb shock energy by an irreversible plastic deformation and a second member configured to absorb shock energy by a reversible elastic deformation and wherein the first member is embedded in the second member; wherein the first member comprises a plurality of open cells interconnected to each other via their sidewalls to form a pliable sheet configured to absorb energy through irreversible deformation of said sidewalls or said interconnections in response to a compressive load applied to said sheet.

2. Body-protector according to claim 1, wherein said second member is a single piece made of an elastic material.

3. Body-protector according to claim 2, wherein the elastic material of the second member is of the transparent type.

4. Body-protector according to claim 1, wherein said sidewalls of the cells are at least in part normal to an inner face of the shock-absorbing pad.

5. Body-protector according to claim 1, wherein said sheet has a thickness comprised between 0.5 and 30 mm.

6. Body-protector according to claim 1, wherein the cross-sectional area of said cells is comprised between 1.5 $mm^2$ and 30 $mm^2$.

7. Body-protector according to claim 1, wherein the second member comprises a recess wherein the first member is enclosed.

8. Body-protector according to claim 1, wherein the first member is fully encapsulated in the second member.

9. Body-protector according to claim 8, wherein the second member permeates the cells of the first member.

10. Body-protector according to claim 1, wherein the first member is sandwiched between a part of the second member and the wearable article.

11. Body-protector according to claim 1, wherein the shock-absorbing pad is anchored to an outer side of the wearable article so to remain exposed during normal use.

12. Body-protector according to claim 1, wherein said second member comprises one or more outward directed thickenings and one or more cuts arranged on an outer surface of the second member.

13. Body-protector according to claim 12, wherein said one or more cuts are arranged in correspondence of said one or more thickenings.

14. Body-protector according to claim 12, wherein said second member comprises thinnings in-between said thickenings.

15. Body-protector according to claim 14, wherein said first member narrows or is absent in correspondence of said thinnings.

16. Body-protector according to claim 1, wherein said wearable article is a glove and said shock-absorbing pad is anchored to a back of the glove.

17. Body-protector according to claim 16, wherein the second member comprises one or more outward directed thickenings and one or more cuts arranged on the outer surface of the second member and said cuts extend in a width direction of the glove and said thickenings are arranged in correspondence of metacarpophalangeal joints and/or knuckle joints of the glove.

18. Body-protector according to claim 17, wherein said cuts are normal or inclined with respect to an outer face of the shock-absorbing pad.

19. Body-protector according to claim 16, wherein a single piece of the first member covers the back and at least two finger portions of the glove.

20. Body-protector according to claim 16, wherein the second member comprises lateral extensions wrapping, at least in part, finger portions of the glove.

* * * * *